United States Patent [19]

Bolot et al.

[11] Patent Number: 4,653,692

[45] Date of Patent: Mar. 31, 1987

[54] TORCHE NOZZLE WITH INTERNAL GAS MIXING

[75] Inventors: Denis Bolot, Pontoise; Francis Cuny, Mezy-sur-Seine; Didier Lasnier, Cergy, all of France

[73] Assignee: L'Air Liquide, Societe Anonyme Pour L'Etude Et L'Exploitation des Procedes Georges Claude, Paris, France

[21] Appl. No.: 782,592

[22] Filed: Sep. 30, 1985

[30] Foreign Application Priority Data

Oct. 3, 1985 [FR] France ..... 84 15154

[51] Int. Cl.[4] ..... B05B 7/04

[52] U.S. Cl. ..... 239/427; 239/433; 239/590.5

[58] Field of Search ..... 239/427, 433, 434, 434.5, 239/590.3, 590.5; 266/48

[56] References Cited

U.S. PATENT DOCUMENTS 1,526,923 2/1925 Meden ..... 239/434
1,940,343 12/1933 Bennett et al. ..... 239/430
2,231,199 2/1941 Smith ..... 239/434.5
2,348,839 5/1944 Oldham .
2,468,824 5/1949 Hughey ..... 239/434.5

FOREIGN PATENT DOCUMENTS 1541971 10/1968 France .

*Primary Examiner*—Andres Kashnikow
*Assistant Examiner*—Michael J. Forman
*Attorney, Agent, or Firm*—Young & Thompson

[57] ABSTRACT

This nozzle includes an outer case (1) and a core (2) which define in succession: a series of passageways (15) having a zone for the injection of fuel gas and comburent gas, a mixing zone of small section and a primary homogenization zone of larger section; an annular secondary homogenization zone (16) whose section is substantially equal to the total section of the preceding zone; a single acceleration passage (17) having a decreasing section; and a single outlet conduit (18) having a constant section. Application in oxyacetylene torches consuming a few cubic meters per hour acetylene.

7 Claims, 3 Drawing Figures

TORCHE NOZZLE WITH INTERNAL GAS MIXING

The present invention relates to a torch nozzle with internal gas mixing, of the type comprising an outer annular case and a core disposed in this case, the case and the core defining a series of passageways each of which comprises in succession, from the upstream end, an injection zone adapted to be supplied with fuel gas and comburent gas, a small-section mixing zone and then a homogenizing zone of distinctly larger section, the outer case being extended beyond the end of the core and forming at its downstream end a single outlet conduit for the mixture.

It is known that two main families of torches exist: torches providing a prior overall gas mixing and torches providing a gas mixing within the nozzle.

In the first torches, the mixture of fuel and comburent is effected well upstream of the nozzle, at several decimeters from the outlet orifice, which delivers a single flame. These torches have the advantage of simplicity of construction, in particular as concerns the nozzle, which is a vulnerable part. On the other hand, in the event of re-entry of the flame (brought about for example by a partial obstruction of the outlet orifice of the nozzle), the flame front penetrates the interior of the torch and may be stabilized in the region of the injector. This phenomenon is liable to destroy the torch and, in the case of a manual apparatus, burn the hand of the operator.

In the second torches, the injection, the mixing and the homogenization of the mixture are effected within the nozzle. As it is difficult to mix and homogenize flows higher than 500 liters/hour in a length as short as that of a nozzle (a few centimeters), their principle has led, for the purpose of attaining flows of several cubic meters/hour, to dividing the total flow into a plurality of identical milled passageways evenly spaced apart around the nozzle.

The essential advantage of the torches of the second family resides in very great safety in use: in the event of the re-entry of the flame, this usually concerns only a single passageway and, as the distance between the flame front and the injector is short, the concerned volume of explosive mixture is considerably smaller than with a torch providing a prior mixture. In any case, even in the event of a generalized re-entry of the flame (which is improbable), there is absolutely no risk for the hand of the operator, which is at a distance of several decimeters from the nozzle.

In most known nozzles providing an internal mixture, the principle of division of the flow has led to the provision of passageways extending to the front end of the nozzle, so that it concerns multi-flame nozzles, which excludes certain applications, for example shrinkage heating, which require a localized heating. Further, U.S. Pat. No. 1,940,343 proposes a single-flame nozzle with internal gas mixing which is of the type mentioned above. However, this nozzle has certain drawbacks, in particular in respect of the design of the homogenization zone and its connection to the mixture outlet conduit.

An object of the invention is to provide a mono-flame nozzle which, for a moderate total-length, ensures the ejection of a well homogenized mixture under excellent conditions in respect of flows which may reach several cubic meters/hour.

For this purpose, the invention provides a torch nozzle of the aforementioned type, wherein the passageways open onto an annular space defined between the outer case and the core and having a substantially constant section equal to the total section of the passageways, this annular space in turn opening onto a single passage having a decreasing section defined by the outer case and having a downstream end which forms said single mixture outlet conduit.

An embodiment of the invention will now be described with reference to the accompanying drawing, in which.

Figure 1:
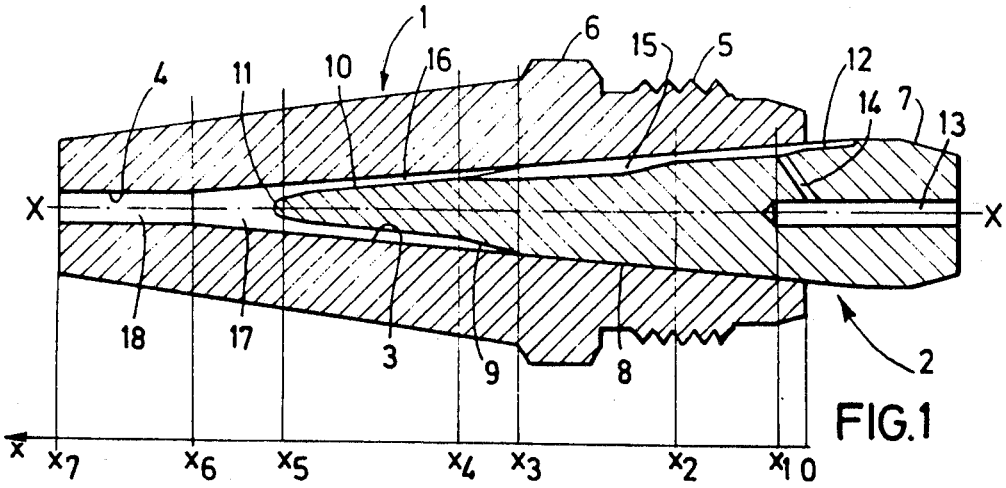
FIG. 1 is a longitudinal sectional view of the torch nozzle according to the invention.

The torch nozzle shown in FIG. 1 comprises two elements: an outer case and an inner core. It is generally a figure of revolution about an axis X-X. For the convenience of description, it will be assumed that this axis is horizontal and that the gases flow from the right end (upstream end) to the left end (downstream end) of the nozzle. Reference will subsequently be made to abscissae x counted from the right to the left along the axis X-X, from an origin ($x=0$) corresponding to the plane of the upstream end of the case to a value $x=x_7$ corresponding to its downstream end plane.

The inner wall of the case 1 has two portions: in the major part of its length, from $x=0$ to $x_6$, a convergent frustoconical portion 3 and then a cylindrical portion 4 extending from $x_6$ to $x_7$.

Externally, the case 1 has in it upstream portion a screwthread 5, for connection to a torch head (not shown), then a tightening hexagonal portion 6 and then a shape convergent to its downstream end.

Figure 2:
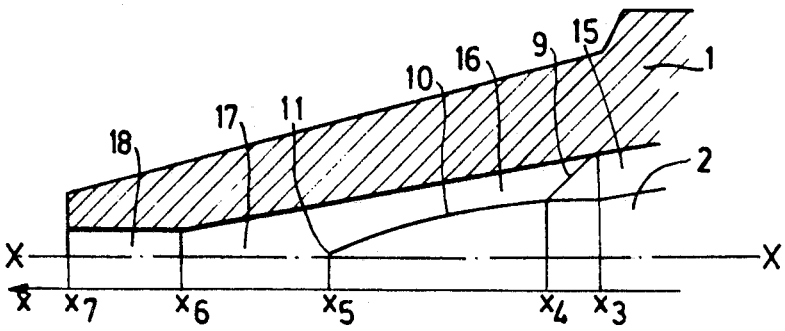
FIG. 2 is a partial longitudinal semi-sectional view of a detail of the construction of this nozzle.

The core 2 has the general shape of a conical needle having the same apex angle as the portion 3 of the cavity of the case, so that it can be positioned and fixed in the latter by a simple jamming. More precisely, this core has in the direction from the upstream end to the downstream end:

- a divergent portion 7, outside the case 1, adapted to be applied in a fluidtight manner against a conjugate bearing portion of the torch head;
- up to the abscissa $x_3$, located roughly half-way along the length of the portion 3 of the case, a convergent frustoconical portion conjugate with this portion 3;
- from $x_3$ to $x_4$, a short, more steeply frustoconical zone 9; and from $x_4$ to $_5$, a nose 10 of parabolic shape which terminates in a rounded point 11, for example having a radius of 0.3 mm, as can be seen best in FIG. 2.

From a point located outside the case to the abscissa $x_4$, the core 2 has a series of longitudinal grooves 12 evenly spaced apart on its periphery. It also has, starting at its upstream end, a blind axial bore 13 and, leading from the latter, a series of conduits 14 each of which opens onto a respective groove 12 at a certain distance $x_1$ from the upstream end plane of the case 1.

Starting at the abscissa $x=0$, the grooves 12 define with the wall portion 3 of the case as many passageways 15 whose section of passage, defined by the depth of the grooves, varies: this section, after having increased from $x=0$ to $x_1$ (injection of the fuel), is small from $x_1$ to $x_2$, and then distinctly larger from $x_2$ to $x_3$. The grooves 12 then gradually disappear in the zone 9, which constitutes a transition zone in which the channels open onto an annular space 16 defined between the core and the case from $x_3$ to $x_5$.

If s designates the section of each passageway 15 at the abscissa $x_3$, n the number of passageways and S the section of the annular space 16 at the abscissa $x_4$, there is substantially obtained $S=n.s$ to within $\pm 10\%$.

From $x_4$ to $x_5$, the parabolic profile of the core 2 is so chosen that the section of the annular space 16 remains substantially constant and equal to the value S defined above.

From $x_5$ to $x_6$, the wall portion 3 of the case 1 itself defines a single passage 17 having a decrerasing circular section; from $x_6$ to $x_7$, the wall portion 4 defines a single conduit 18 having a constant circular section and connected to the passage 17.

In operation, the nozzle thus described is fixed to the head of a torch; fuel gas, for example acetylene, is conveyed to the bore 13 of the core, and oxygen is injected into the upstream end of the grooves 12. The following phenomena are then produced in each passageway 15:

under the effect of its own supply pressure and of the aspiration created by the oxygen, the fuel gas enters the conduit 14 and is ejected into the passageway 15 at the abscissa $x_1$;

from $x_1$ to $x_2$, a high velocity of the gas stream (small section of passage) causes the creation of turbulences facilitating a mixing of the oxygen and fuel gas streams. This zone is a zone for mixing the two gases; and from $x_2$ to $x_3$, the considerable increase in the section offered to the passage of the gas slows down the velocity of the mixture so as to allow it time to be homogenized. This zone constitutes a primary homogenization zone for the mixture.

The gas streams join together in the transition zone 9 and then flow in the annular space 16. As the section of this space is constant, the homogenization is merely pursued, i.e. the space 16 constitutes a secondary homogenization zone.

Thereafter, the mixture travels through the passage 17 where it undergoes an acceleration until it reaches, at the entrance of the conduit 18, sufficient velocity to balance the velocity of deflagration of the mixture at the outlet of the nozzle.

Figure 3:
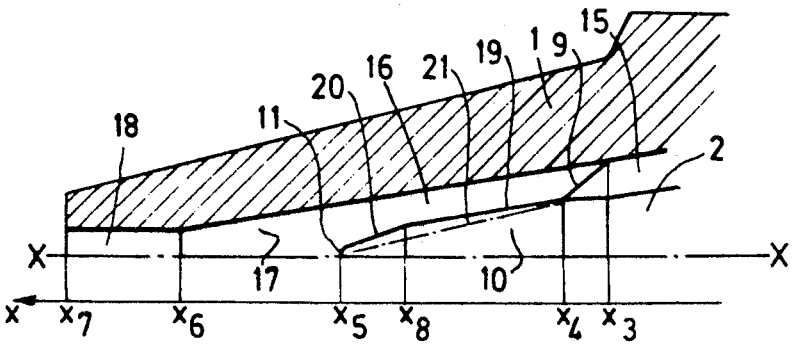
FIG. 3 is a partial longitudinal semi-sectional view of a modification.

In the modification shown in FIG. 3, the nose 10 of the core is so modified as to facilitate its construction: instead of having a strictly parabolic profile, this nose is formed by an upstream truncated core 19 followed by a downstream cone 20 which is more convergent and terminates in the same rounded point 11 as before.

The circle of connection between the truncated cone 19 and the cone 20 is located at the abscissa $x_8$ intermediate between $x_4$ and $x_3$ in respect of which the section of passage of the gas would be maximum if the nose 10 were a single cone 21 extending from $x_4$ to $x_5$, as shown in dot-dash lines in FIG. 3.

With such an arrangement of the nose 10, there is still obtained: $S(x_4)=S(x_5)=S(x_8)=n.s$ to within $\pm 10\%$, so that the behavior of the mixture in the space 16 remains practically the same as with the configuration of FIGS. 1 and 2.

The applicants have tested successfully an oxyacetylene nozzle with internal gas mixing according to the modification of FIG. 3 in respect of flows of acetylene varying up to 3 cubic meters per hour. As concerns oxygen/acetylene consumption ratios close to stoichiometry, no sensitivity to flame penetration has been found.

What is claimed is:

1. A mono-flame torch nozzle with internal gas mixing, the nozzle having a longitudinal axis and comprising an outer annular case and a core disposed in said case, the nozzle defining passage means extending from an upstream end portion to a downstream end of the nozzle and defining in succession, from said upstream end portion to said downstream end: a series of passageways angularly spaced along said axis and each defining in succession, from said upstream end portion, an injection zone provided with fuel gas inlet means and comburent gas inlet means, a mixing zone of comparatively small cross-sectional area, and a homogenizing zone of distinctly larger cross-sectional area than the mixing zone; an annular space defined between the case and the core and extending to a downstream end of the core, said passageways opening onto said annular space, said annular space having a cross-sectional area which is substantially constant and equal to the total cross-sectional area of said passageways where said passageways open onto said annular space; and a single passage of circular cross-section, said single passage being defined by the outer case, said annular space opening onto said single passage, said passage having a decreasing cross-sectional area to a downstream end portion which forms a single fuel gas and comburent gas mixture outlet opening at said nozzle downstream end.

2. A torch nozzle according to claim 1, wherein, in a region of said annular space, the outer case has a frustoconical inner profile and the core has a substantially parabolic profile with both said profiles being narrowest in a downstream direction.

3. A torch nozzle according to claim 1, wherein, in a region of said annular space, the outer case has a frustoconical inner profile and the core has a profile comprising an upstream truncated cone followed by a downstream cone having a larger apex angle, relative to the gas flow through the nozzle, both said cones and said case have wider upstream ends and narrower downstream ends.

4. A torch nozzle according to claim 1, wherein said single passage has a circular cross section between the end of the core and said outlet opening.

5. A torch nozzle according to claim 1, wherein said single passage is cylindrical.

6. A torch nozzle according to claim 1, wherein the outer case has a frustoconical profile up to said outlet opening, said profile having a wider upstream end and a narrower downstream end.

7. A torch nozzle according to claim 1, wherein the downstream end of the core has a rounded point.

* * * * *